US005528795A

United States Patent [19]

Gramegna

[11] Patent Number: 5,528,795

[45] Date of Patent: Jun. 25, 1996

[54] HANDLE STRUCTURE WITH A SWINGABLE CURVED GRIP ELEMENT PARTICULARLY FOR LUGGAGE CONTAINMENT MEANS

[75] Inventor: Virma Gramegna, Casalecchio Di Reno, Italy

[73] Assignee: Plastimoda S.p.A., Desio, Italy

[21] Appl. No.: 221,598

[22] Filed: Apr. 1, 1994

[30] Foreign Application Priority Data

Apr. 14, 1993 [IT] Italy ..... B0930080 U

[51] Int. Cl.[6] ..... A45C 13/26

[52] U.S. Cl. ..... 16/112

[58] Field of Search ..... 16/112, 119, 125, 16/126, 127, DIG. 24, DIG. 25, 39; 190/155, 157

[56] References Cited

U.S. PATENT DOCUMENTS

| | | | |
|---|---|---|---|
| 2,332,765 | 10/1943 | Thiele | 16/125 |
| 3,183,549 | 5/1965 | Hammesfahr | 16/125 |
| 4,364,150 | 12/1982 | Zemington | 190/115 |

*Primary Examiner*—M. Rachuba
*Assistant Examiner*—Kenneth J. Hansen
*Attorney, Agent, or Firm*—Guido Modiano; Albert Josif

[57] ABSTRACT

The handle includes a curved grip element having, at its opposite ends, elements for articulation to respective components for coupling to the bag. Respective accordion-like or bellows-like trimming components are associated with the ends of the grip element and are suitable to cover the articulation elements.

4 Claims, 3 Drawing Sheets

HANDLE STRUCTURE WITH A SWINGABLE CURVED GRIP ELEMENT PARTICULARLY FOR LUGGAGE CONTAINMENT MEANS

BACKGROUND OF THE INVENTION

The present invention relates to a handle for bags, suitcases and the like luggage containment means.

It is known that several kinds of bag, suitcase and the like have a handle constituted by a curved grip element which is articulated to the bag, at its opposite ends, by means of appropriate hinges. These hinges allow the handle to swing about an axis that lies along the handle median longitudinal plane.

In known bags, the hinge parts of the handle are generally visible. This is not always desirable from an aesthetic viewpoint and furthermore requires particular care in the machining of said hinge parts, which are often made of metal.

SUMMARY OF THE INVENTION

A principal aim of the present invention is to solve the above described problem by providing a handle for bags and the like luggage containment means having fully covered articulation means, so as to furthermore provide a pleasant aesthetic effect.

Another aim of the present invention is to provide a handle for bags and the like which is simple in concept, safely reliable in operation and versatile in use.

With these and other aims in view, there is provided, according to the present invention, a handle for bags and the like, including: a curved grip element having, at its opposite ends, means for articulation to respective components for coupling to the bag; and a pair of accordion-like or bellows-like trimming components which are associated with said ends of said grip element and are suitable to cover said articulation means.

BRIEF DESCRIPTION OF THE DRAWINGS

The details of the invention will become apparent from the following detailed description of a preferred embodiment thereof, illustrated only by way of non-limitative example in the accompanying drawings, wherein.

DESCRIPTION OF THE PREFERRED EMBODIMENTS

Figure 1:
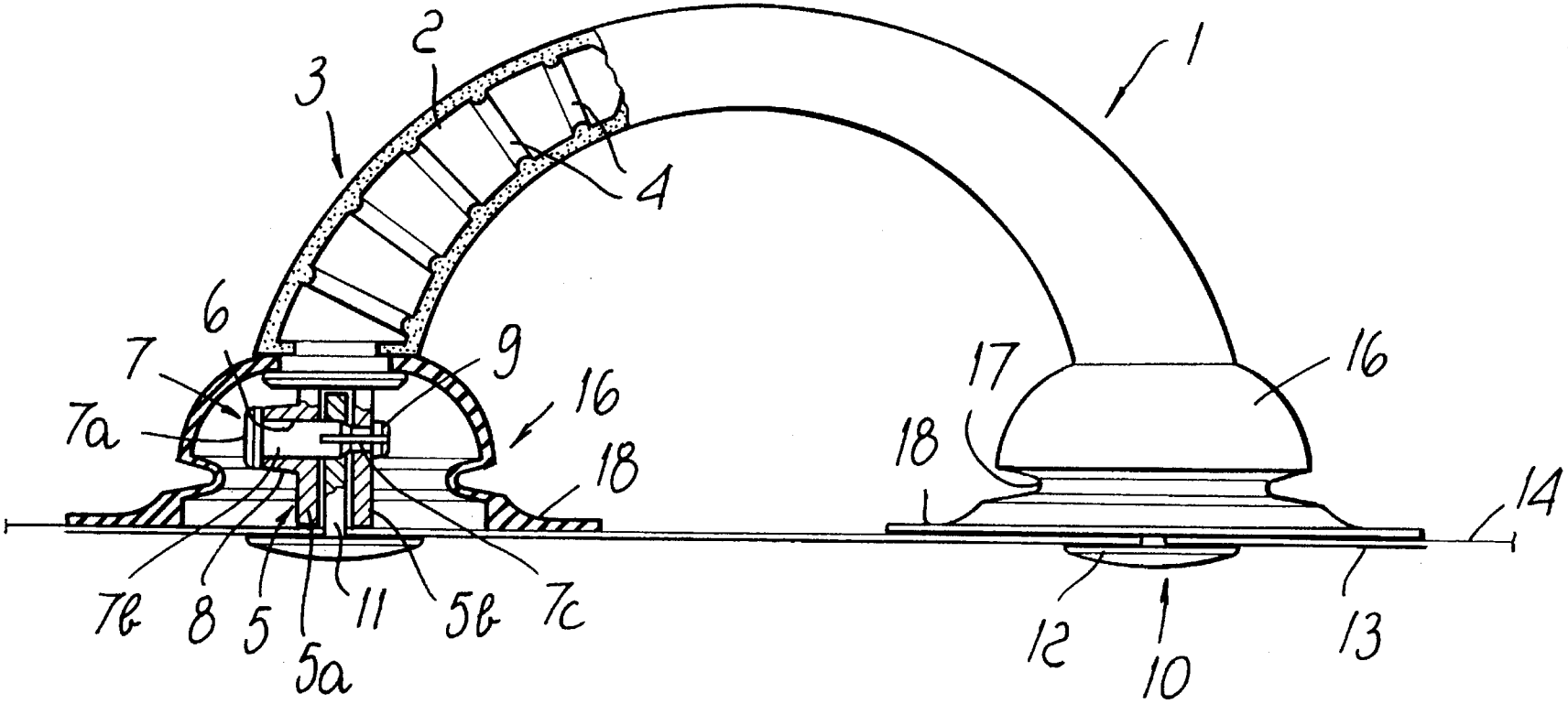
FIG. 1 is a partially sectional front view of the handle according to the invention.
Figure 2:
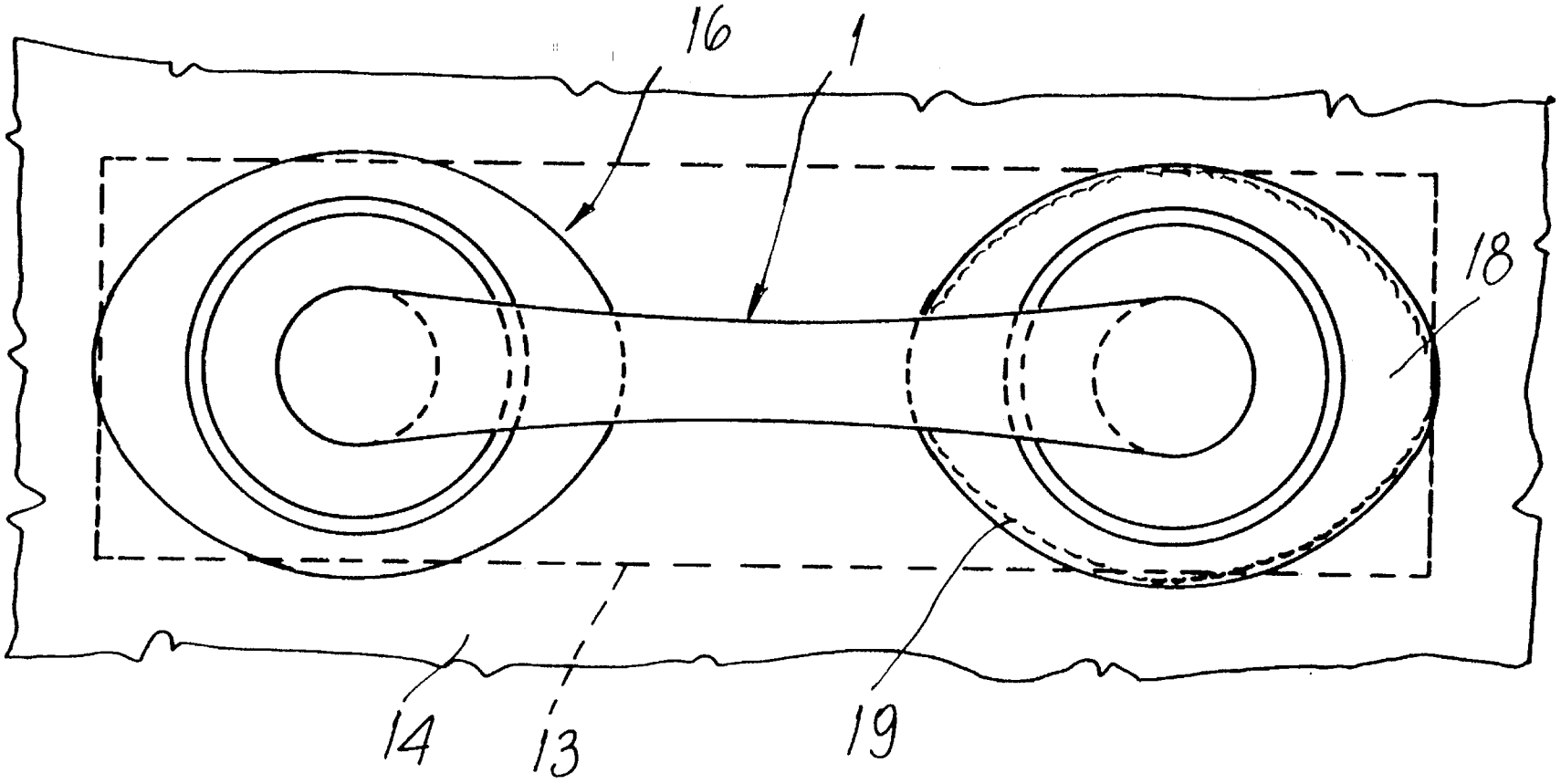
FIG. 2 is a top view of said handle.
Figure 3:
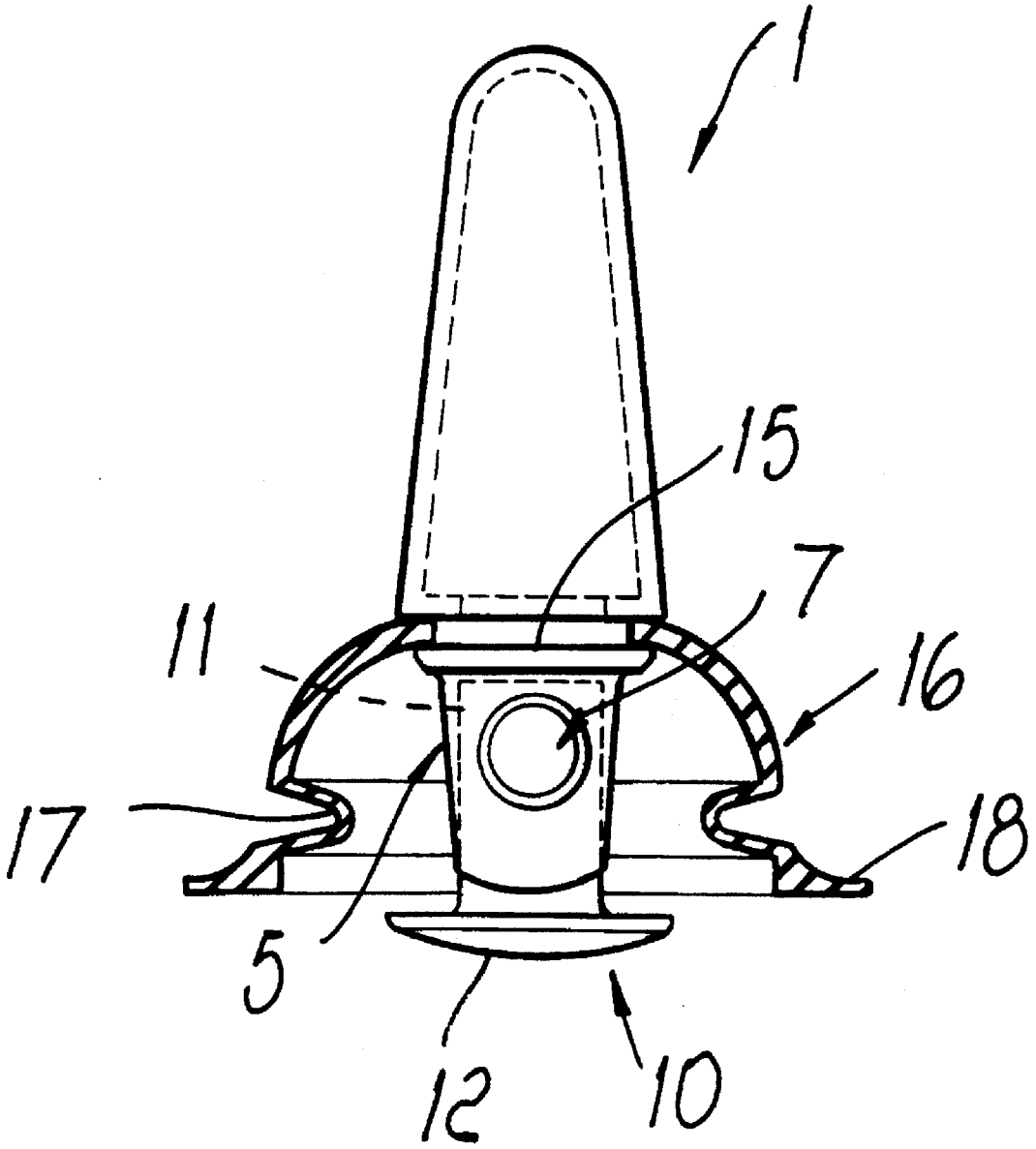
FIG. 3 is a transverse sectional view of said handle.

With particular reference to the above figures, the reference numeral 1 generally designates the handle according to the invention, which forms a curved grip element. Said grip element comprises a core 2 made of rigid plastic material, particularly polyamide, which is covered by a sheath 3 of soft material preferably obtained by molding thermoplastic material.

Conveniently, the cross-section of the core 2 decreases from its opposite ends toward the center, and said core has a plurality of evenly spaced transverse grooves 4 for anchoring the sheath 3.

At its opposite ends the handle forms, monolithically with the core 2, a pair of forks 5 with tines 5*a*, 5*b* that are mutually parallel and lie along ideal planes which are transverse to the median longitudinal plane of said handle. The tines 5*a*, 5*b* of the forks 5 have a respective transverse hole 6, formed along an axis that lies on said longitudinal plane, for the insertion of a retainer or articulation pin 7; for better coupling, the tines 5*a* directed outward with respect to the handle form a sleeve 8 for guiding the pin 7.

The pin 7 is made of plastics, particularly polyamide, and has, starting from its head 7*a*, portions 7*b* and 7*c* having different diameters; the end portion 7*c*, which has a smaller diameter, is longitudinally affected by a diametrical slot and has, at its tip, a lip 9 having a conical profile. The head 7*a* of the pin abuts against the sleeve 8 of the fork 5.

The pin 7 thus enters the hole of the fork 5 in a snap-together manner and is locked by the lip 9 so that it cannot be removed.

The articulation pin 7 is meant to provide the rotary coupling of the handle to a corresponding connection component 10 for connection to the bag. The component 10, equally made of plastics, particularly polyamide, comprises a tab 11 extending diametrically from a disk 12 and suitable to be inserted between the tines 5*a*, 5*b* of the associated fork 5; said tab is crossed by the pin 7 at an appropriate hole.

The disk 12 is meant to abut against a panel 13 for stiffening the bag in the region where the handle is connected; said panel 13, conveniently made of metal, is placed below the layer 14 of the material of the bag, such as leather, fabric or the like.

The forks 5 extend respectively from a disk-shaped portion 15 that forms an annular groove with respect to the curved portion of the handle. The top of an accordion-like or bellows-like trimming component 16, made of a material such as rubber, engages in said groove and is suitable to cover the handle articulation means described earlier.

The accordion-like or bellow-like trimming component 16 is formed by a spherical dome which is provided, along its edge, with an annular fold 17 for elastic connection to a flattened base 18 having an oval shape. Said base 18 is coupled by a conventional stitching 19 to the layer 14 of the bag thereby the bottom surface of the base 18 engaging the layer 14.

The accordion-like or bellows-like trimming components 16 allow in practice to fully cover the regions where the handle is articulated to the bag but allow the conventional movement of said handle. The accordion-like components in fact deform elastically, following the movement of the handle, to which they are coupled at their top.

It should be noted that said accordion-like elements can be provided in different colors, allowing any desired color combination with the bag and with the handle itself.

In addition to protecting the handle articulation means, the accordion-like components thus achieve an appreciable aesthetic improvement of the handle.

In the practical embodiment of the invention, the materials employed, as well as the shape and dimensions, may be any according to the requirements.

What I claim is:

1. A handle structure for luggage containment means, comprising: a curved grip element having a substantially rigid core and opposite ends, a sheath of soft material covering said core, articulation means for swingably connecting said grip element onto a luggage containment means, said articulation means being located at and extending from said opposite ends of said grip element, an elastic trimming cover at each of said opposite ends of said grip element arranged to cover said articulation means, said elastic trimming covers having a bellows structure including a top portion thereof connected to one of said opposite ends and a base portion having surface means for engaging said luggage containment means, and wherein said elastic trimming covers have said top portion thereof being in the form of a spherical dome and between said top portion and said base portion at least one annular fold, said base portion having a flattened configuration extending from said annular fold.

2. A handle structure for luggage containment means, comprising: a curved grip element having a substantially rigid core and opposite ends, a sheath of soft material covering said core, articulation means for swingably connecting said grip element onto a luggage containment means, said articulation means being located at and extending from said opposite ends of said grip element, an elastic trimming cover at each of said opposite ends of said grip element and arranged to cover said articulation means, said elastic trimming covers having a bellows structure including a top portion thereof connected to one of said opposite ends and a base portion having surface means for engaging said luggage containment means and wherein said elastic trimming covers have said top portion thereof in the form of a spherical dome and between said top portion and said base portion at least one annular fold, said base portion having a flattened configuration extending from said annular fold and wherein said elastic trimming covers are made of a differently coloured elastic material and said opposite ends of said curved grip element have a disk-shaped end portion forming an annular groove and wherein said articulation means extend from said disk-shaped portion, said elastic trimming cover having said top portion thereof engaging in said groove.

3. A handle structure for luggage containment means, comprising: a curved grip element having a substantially rigid core and opposite ends, a sheath of soft material covering said core, articulation means for swingably connecting said grip element onto a luggage containment means, said articulation means being located at and extending from said opposite ends of said grip element, an elastic trimming cover at each of said opposite ends of said grip element and arranged to cover said articulation means, said elastic trimming covers having a bellows structure including a top portion thereof connected to one of said opposite ends and a base portion having surface means for engaging said luggage containment means and wherein said elastic trimming covers have said top portion thereof in the form of a spherical dome and between said top portion and said base portion at least one annular fold, said base portion having a flattened configuration extending from said annular fold and wherein said elastic trimming covers are made of a differently coloured elastic material and said opposite ends of said curved grip element have a disk-shaped end portion forming an annular groove and wherein said articulation means extend from said disk-shaped portion, said elastic trimming cover having said top portion thereof engaging in said groove, wherein said curved grip element defines a median longitudinal plane thereof, said articulation means comprising a fork structure extending from said disk-shaped end portion and having tines and a hole extending through said tines transverse to said median longitudinal plane and further comprising an articulation pin for snap-together insertion into said hole and a connection member for connection to said luggage containment means and rotatorily engaging said articulation pin, wherein said articulation pin comprises an end portion having a longitudinally extending diametrical slot and a tip including a lip having a conical profile for preventing removal of said pin from said tines.

4. The handle structure according to claim 3, wherein said core of said grip element has a plurality of transverse grooves for anchoring thereon said soft sheath and wherein the cross-section of said core decreases from its opposite ends towards the center thereof.

* * * * *